US005605402A

United States Patent [19]

Uggetti

[11] Patent Number: 5,605,402

[45] Date of Patent: Feb. 25, 1997

[54] INKED RIBBON CARTRIDGE WITH A RIBBON INKING ELEMENT

[75] Inventor: Sergio Uggetti, Ivrea, Italy

[73] Assignee: Baltea S.p.A., Ivrea, Italy

[21] Appl. No.: 429,149

[22] Filed: Apr. 26, 1995

[30] Foreign Application Priority Data

Apr. 28, 1994 [IT] Italy ..... TO94A0339

[51] Int. Cl.[6] ..... B41J 33/34

[52] U.S. Cl. ..... 400/192; 400/197

[58] Field of Search ..... 400/192, 196, 400/196.1, 197, 249, 247, 200, 201, 202.1, 202.2, 202.3, 202.4; 101/96, 100, 102, 107

[56] References Cited

U.S. PATENT DOCUMENTS 4,175,877 11/1979 Randolph ..... 400/196
4,636,097 1/1987 Groubeaux ..... 400/197
4,913,571 4/1990 Bulson et al. ..... 400/196.1
5,215,012 6/1993 Kanno et al. ..... 400/196.1

FOREIGN PATENT DOCUMENTS 0248677 10/1987 Japan ..... 400/196.1
2264926 9/1993 United Kingdom ..... 400/196.1

*Primary Examiner*—Edgar S. Burr
*Assistant Examiner*—Anthony H. Nguyen
*Attorney, Agent, or Firm*—Banner & Witcoff, Ltd.

[57] ABSTRACT

This invention relates to a cartridge 11 for a printing ribbon 13 comprising a container 12 which houses an inked ribbon 12, a ribbon feeding roller 18 and a ribbon inking element 14. The inking element 14 is selectively actuated from a rest condition in which, during the cartridge utilization initial phase, the inking element does not supply the ribbon 13 with ink, to a work condition in which the inking element 14 supplies the ribbon with ink. A reducing unit 34 and a cam 33,42 are provided for automatically actuating the inking element 14 and guide it from the rest to the work condition, when a predetermined number of turns is reached by the feeding roller 18 for advancing the ribbon.

5 Claims, 2 Drawing Sheets

INKED RIBBON CARTRIDGE WITH A RIBBON INKING ELEMENT

FIELD OF THE INVENTION

The present invention relates to a cartridge for a printing ribbon of printers or similar equipments, comprising a container which houses an inked ribbon, a ribbon feeding roller, and a ribbon inking element. The inked ribbon is of a type shaped as a closed ring, and it is made by a web impregnated with ink. During the printing, the inked ribbon is pressed against a printing support by a writing head of an impact type, for transferring ink to such printing support and so forming printing characters and symbols. In order to increase the cartridge life, the inked ribbon is supplied with new ink by the inking element, till its exhaustion.

BACKGROUND OF THE INVENTION

From the Italian Patent No. 1059927 issued to the Applicant on the 21st June 1982, it is known a cartridge of this type in which the inking element is formed by an element of porous material, containing an ink reserve constantly held in contact with the ribbon. In this case, the inking element supplies ink to the ribbon during all the cartridge operating life, showing two kinds of disadvantages. The first disadvantage depends on the fact that, when the cartridge is new, the ribbon does not need to be inked by the inking element being the ribbon already inked by a sufficient quantity of ink, which is suitable to allow an optimum printing during a first phase of the cartridge utilization. Therefore the inking of the ribbon, in this first phase, can render the ink quantity in the ribbon excessive and cause printing spots. The second disadvantage depends on the fact that the inking element, supplying ink in the first phase of the cartridge utilization, soon exhausts its ink reserve, causing a lower duration of the cartridge.

SUMMARY OF THE INVENTION

The technical problem that the present invention aims to solve is that of realizing a cartridge in which the inking element does not supply the ribbon with ink during a first phase of the cartridge utilization, corresponding to a significant part of the cartridge working life, since the inking element supplies the ribbon with ink only in a second phase, subsequent the first one and which continues till the end of the cartridge working life, and a cartridge in which there is not required any operation from the operator in order to pass from the first to the second phase.

This technical problem is solved by the cartridge according to the present invention, which is characterized in that the inking element is selectively activable from a rest condition in which the inking element does not co-operate with the ribbon during the initial phase of the cartridge utilization, to a work condition in which the inking element supplies the ribbon with ink during the remaining phase of the cartridge utilization, and in that actuating means are provided to actuate automatically the inking element and to guide it from the rest to the work condition, after a predetermined number of turns of the ribbon feeding roller.

BRIEF DESCRIPTION OF THE DRAWINGS

This and others features of the invention will be clear by the following disclosure, given by way of a not limiting and not restrictive example, with reference to the accompanying drawings, in which.

DETAILED DESCRIPTION OF A PREFERRED EMBODIMENT

Figure 1:
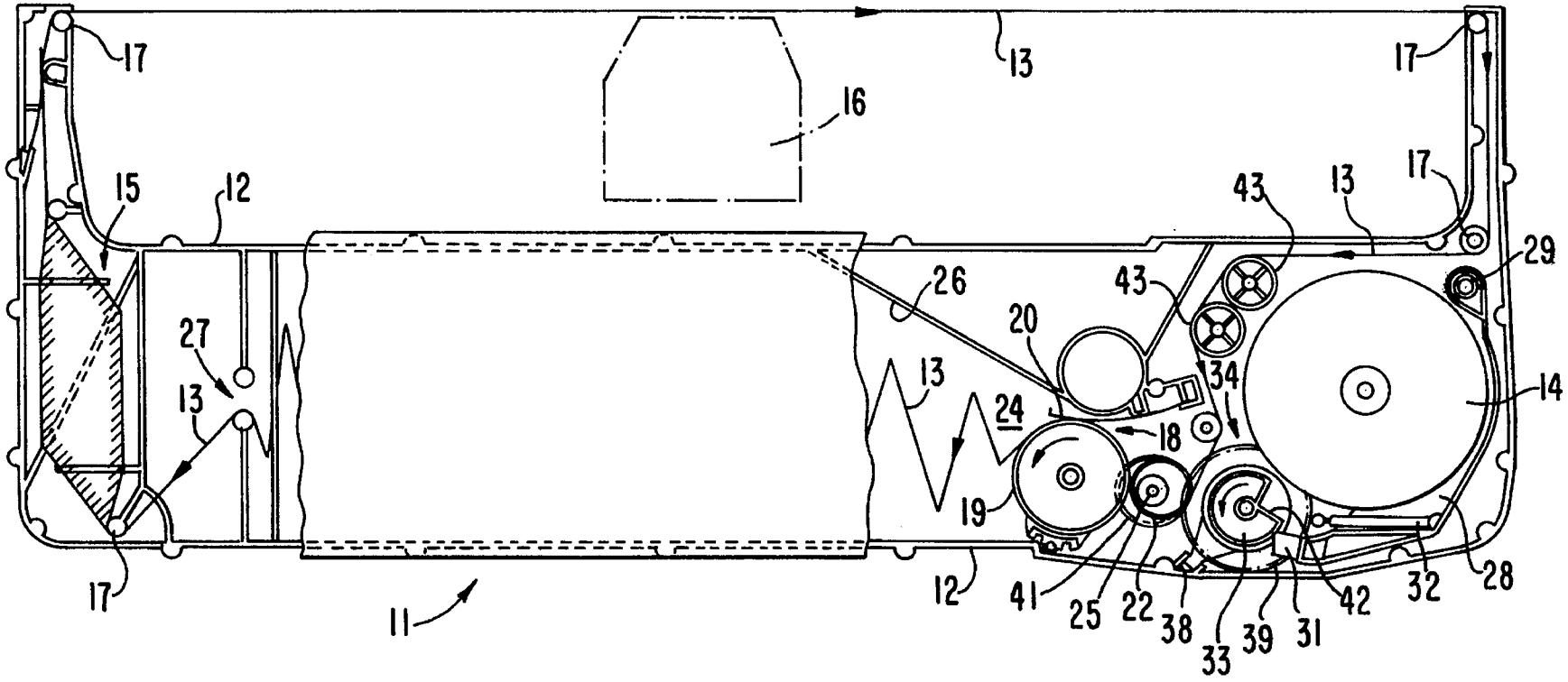
FIG. 1 is a plan view of a cartridge according to the invention.

Referring to FIG. 1 the inked cartridge according to the present invention, generally indicated with 11, comprises a container 12 which houses a ribbon 13, and an inking element 14. The ribbon 13 is closed as a ring accordingly to the shape known as "Möbius ring", according to a technical solution widely used in the writing cartridges field and which permits to alternate the two faces of the ribbon 13 in front of a printing support 16. On the ground of the aforesaid solution, subsequent portions of the ribbon 13 are turned of 180° during crossing a lateral area 15 of the container 12.

The ribbon 13 within the container 12 is guided by posts and driving profiles, generally indicated with 17 and, during the writing, it is made to advance by a ribbon driving member 18, which is formed by a roller 19 provided on its cylindrical surface with rubber elements and a lamella 20, which presses a portion of the ribbon 13 against such rubber elements. The roller 19 rotates counterclockwise and allows the ribbon 13 to advance in the direction of the arrows indicated in various portions of the ribbon 13. The movement of the roller 19 is given by the printer on which the cartridge 11 is mounted, by way of known connecting means among which, in particular, there is a driving shaft 25, which is rotating coaxially on an axle 21, and co-operates with an intermediate element 22 to permit the roller 19 to rotate. The driving shaft 25 extends over the container 12 forming a knurled post 23, which may be operated by the operator for permitting the ribbon 13 to advance manually.

The driving member 18 is mounted in correspondence of an entry 24 of a store 26, in which the ribbon 13 is urged to enter by the member 18 and where the ribbon is arranged in the form of disorderly windings. During the feed of the ribbon 13, these windings move progressively towards an exit 27 of the store 26.

The inking element 14 is constituted by a roller of porous material containing an ink reserve and is mounted rotatably on a frame 28, which is pivoting on a post 29 of the container 12. The frame 28 has an end 31, opposite to the post 29, and constantly pressed by a spring 32 against a rotating element or wheel 33, which is fixed on the upper portion of a reducing unit 34 and rotated by it. The reducing unit 34 is built-in within the container 12 and comprises a series of brackets 37, coaxial to an axle 36 and connected to gears of known type, inside the reducing unit 34. The brackets 37 are corresponding to stages or sections of reduction which the reducing unit applies to an entry number of turns in order to obtain an exit number of turns for driving the wheel 33. The reducing unit 34 is mounted within the container 12 with the brackets 37 which are prevented to rotate with respect of the axle 36, the brackets being engaged against abutment surfaces 38 obtained from the container 12.

The reducing unit 34 mounted in the container 12 is of known type, for example of the type of the reducing mechanism which is described in U.S. Pat. No. 4,431,910.

This type of reducing unit normally comprises a plurality of reduction sections which operate through gears and which are generally connected in series for reducing or dividing progressively an angular rotation, either continuously or step wise, from an input section to an output section of the reducing unit. The reducing units of this type are used for many purposes, for example they can be employed for rotating the numbered wheels of a counter for recording the distance covered by a vehicle, as described in the same U.S. Pat. No. 4,431,910.

The brackets 37 of the reducing unit 34 remain for controlling the reduction sections.

It is also clear that the features of the reducing unit 34, both of a structural and of a functional type, can be easily derived from the above cited prior art, and for this reason the reducing unit 34 will not be described in detail as to its internal structure. The last of these sections, placed at the exit of the reducer 34, guides the wheel 33.

At the entry, the reducing unit 34 includes a gear 39, coaxial to the axle 36, and engaging with a gear 41, which is integral with the driving shaft 25 and is rotated by this one. From what above disclosed, it is clear that the number of turns by which the reducing unit 34 is driven at the entry by means of the gear 39 is in a fixed ratio with the number of turns that the printer transmits to the cartridge through the driving shaft 25 to allow the ribbon 13 to advance. It is also clear that the reducing unit 34 is fit to supply, through the exit wheel 33, a rotation which is indicative of the total advancing performed by the ribbon 13, during the cartridge utilization.

The wheel 33 has a cylindrical surface which angularly extends for about 270° around the axis of the wheel and against this cylindrical surface the end 31 of the frame 28 is pressed. Moreover, the wheel 33, in the part not encompassed by the cylindrical surface, includes a V groove 42, which is adapted for receiving the end 31, after almost a complete turn of the wheel 33. For this reason, the reducing unit 34 is mounted within the container 12, so that the groove 42 is adjacent to the end 31 and immediately after it, according to the Counterclockwise rotation (FIG. 1 ) followed by the wheel 33 during the cartridge utilization. That allows to utilize the rotation of the wheel 33 in an optimal way, before the end 31 should be engaged within the groove 42 under the forcing from the spring 32.

The reducing unit 34 is dimensioned to induce the wheel 33 to make a rotation of about a round angle, during which the wheel moves from a starting position to the engagement position of the end 31 with the groove 42, and in the same time the driving shaft 25 makes a total rotation of about 16.000 rounds, to allow the ribbon 13 to advance. This total rotation corresponds to a significant part of the working life foreseen for the cartridge 11, during which it is utilized for printing about 16 million types.

As the end 31 engages the groove 42, the wheel 33 stops to rotate, and this is due to the fact that, in the internal gears of the reducing unit 34 connected with the wheel 33, there are provided elements, per se known and therefore not shown in the drawings, which co-operate with the wheel 33 to induce it to rotate only up to the moment the wheel 33 reaches the position corresponding to the above mentioned engagement. Subsequently, those elements result inoperative on the wheel 33 and therefore this last one remains on a "loose" condition with respect of the gears of the reducing unit 34, for all the time remaining of the cartridge 11 utilization. During this time the wheel 33 is stopped by the end 31, while the gear 39 continues to rotate.

The engagement of the end 31 in the groove 42 is associated with a rotation of the frame 28, which rotation brings the inking element 14 in contact with at least an inking roller 43, allowing the inking element 14 to transfer ink to the inking roller and to be rotated by this last, as it will be described. The roller 43 is rotatable on the container 12 and is rotated by the advancing ribbon 13, since the roller 43 has a portion of its cylindrical surface constantly embraced by the same ribbon 13. When the inking element 14 and the roller 43 enter in contact, they rotate together every time the ribbon 13 advances. At the same time, the ink deposited in the inking element 14 is transferred to the roller 43 through the reciprocal contact areas on the respective cylindrical surfaces. Subsequently the roller 43 provides to distribute the ink received in such way to the ribbon 13, by means of the cylindrical surface portions of the roller 43 which continuously come in contact with the ribbon 13. The ink supplying to the ribbon 13 from the roller 43, takes place up to the life end of the cartridge 11.

Figure 2:
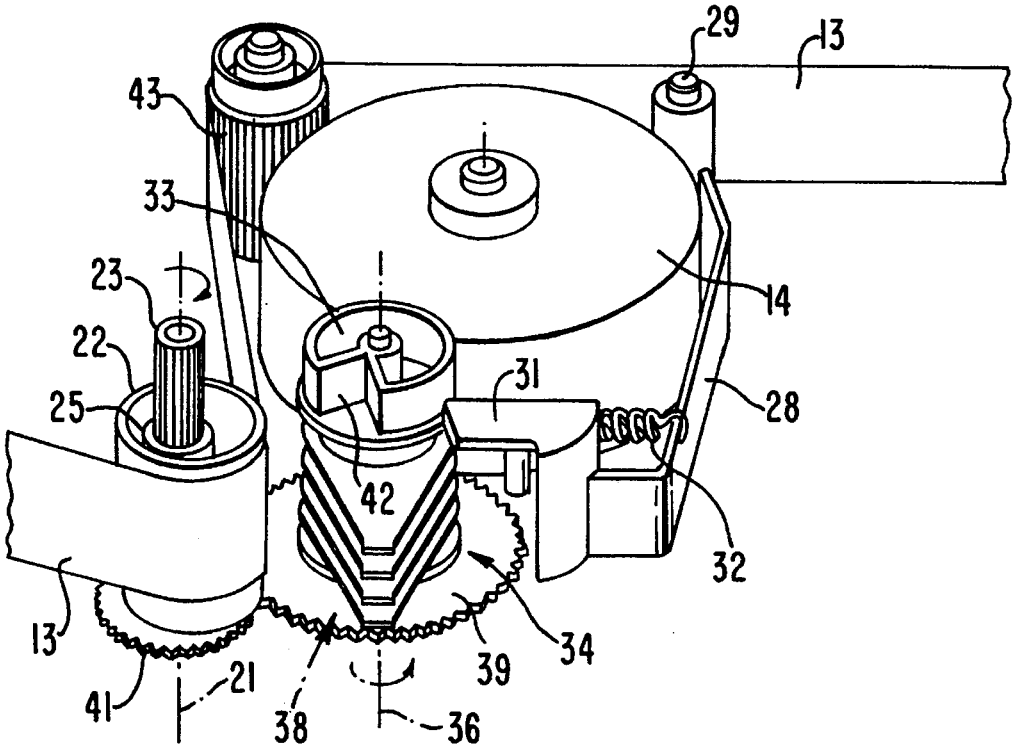
FIG. 2 is a perspective view of a detail of the cartridge of FIG. 1, in a rest condition and in an enlarged scale.
Figure 3:
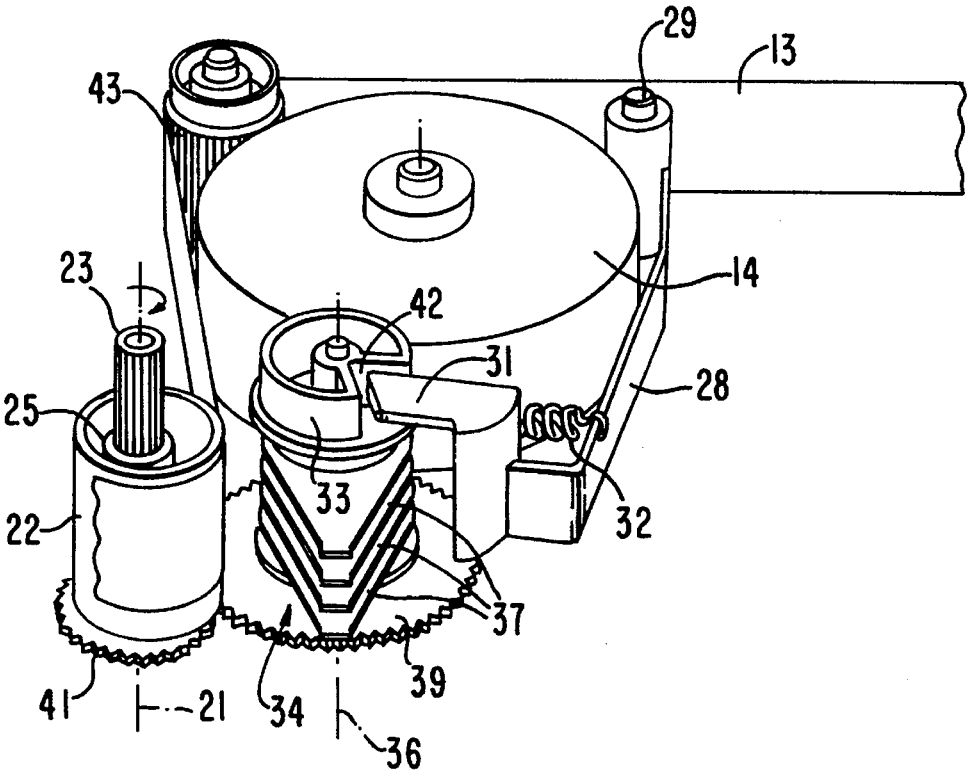
FIG. 3 is the detail of FIG. 2 in a work condition.

In order to optimize the ink supplying of the ribbon 13, the inking rollers 43 can be more than one. For example, two inking rollers 43 are shown in FIG. 1 capable to co-operate with the ribbon 13 and the inking element 14 at the same time, instead of one as shown in FIG. 2 and 3.

It is clear that the cartridge of this invention, in the preferred embodiment above disclosed, may be subject to several modifications and improvements, without departing from the invention sphere.

I claim:

1. A cartridge (11) for a printing ribbon, comprising a container (12), a ring shaped inked ribbon (13) housed in said container (12), a feeding roller (19) rotating in contact with said ribbon for feeding it, and an inking element (14) for inking said ribbon (13), said inking element (14) being selectively movable from a rest position, in which it is separate from said ribbon (13), to a work position in which the inking element (14) contacts the ribbon (13) for supplying it with the ink, wherein the improvement comprises activating means (31, 33, 34) for moving said inking element (14) from said rest position to said work position responsive to a predetermined number of turns of said feeding roller (19) said activating means comprising:

a reducing device (34) having an input rotated synchronously with said feeding roller (19) and an output;

a rotating element (33) fixed to the output of said reducing device (34) for being rotated with a reduced rotation with respect to the rotation of said feeding roller (19) according to a fixed reduction ratio, whereby the rotation of said rotating element (33) is indicative of the number of revolutions of the feeding roller, and means for causing movement of the inking roller (14) from said rest position to said work position after said predetermined number of turns.

2. A cartridge (11) for a printing ribbon according to claim 1, comprising a movable frame (28) on which said inking element (14) is mounted, said rotating element (33) being rotatable from a starting position to a final position which is reached by the rotating element (33) at the completion of the predetermined number of turns of the feeding roller (19) and having a cam member subdivided into a cylindrical surface and a groove (42) adjacent to said cylindrical surface, wherein in correspondence of said final position the groove (42) cooperates with said frame (28) for moving said inking element from said rest position to said work position.

3. A cartridge (11) for printing ribbon (13) according to claim 2, comprising a cam follower (31), rigid with said frame, for cooperating with said cylindrical surface in order to keep said inking element (14) in said rest position during the rotation effected by said rotating element (33) starting from said initial position for reaching said final position, and wherein said groove (42), when said final position is reached, drives said cam follower (31) to move said inking element (14) to said work position and at the same time causes the stopping of said rotating element (18) in said final position.

4. A cartridge (11) for a printing ribbon (13) according to one of the previous claims, comprising at least one inking roller (43) which is constantly held in contact with said inked ribbon (13), wherein said inking element (14) when in said work position is positioned into contact with said inking roller (43) for inking said ribbon through said inking roller (43).

5. A cartridge (11) for a printing ribbon (13) according to claim 3, wherein said reducing device (34) comprises a plurality of reducing sections of which a last section drives the rotation of said rotating element (33), and wherein stop means are provided for stopping said rotating element (33) by disconnecting the latter from the last section, when said rotation element (33) reaches said final position.

* * * * *